United States Patent [19]

Griffin et al.

[11] Patent Number: 4,918,628

[45] Date of Patent: Apr. 17, 1990

[54] STABILITY METER FOR FLOATING OBJECTS

[75] Inventors: Michael J. Griffin, Winsor; Christopher Lewis, Southampton; Anthony Lawther, Portswood, all of United Kingdom

[73] Assignee: University of Southampton, Southampton, United Kingdom

[21] Appl. No.: 391,727

[22] PCT Filed: Dec. 18, 1986

[86] PCT No.: PCT/GB86/00776

§ 371 Date: Sep. 30, 1987

§ 102(e) Date: Sep. 30, 1987

[87] PCT Pub. No.: WO87/03855

PCT Pub. Date: Jul. 2, 1987

Related U.S. Application Data

[63] Continuation of Ser. No. 124,108, Sep. 30, 1987, abandoned.

[30] Foreign Application Priority Data

Dec. 18, 1985 [GB] United Kingdom ..... 8531192

[51] Int. Cl.[4] ..... G06F 15/20; B63B 43/04

[52] U.S. Cl. ..... 364/562; 364/550; 364/559; 364/463; 340/623; 340/689; 73/451; 73/453; 114/123

[58] Field of Search ..... 364/463, 550, 556, 559, 364/560, 562, 566; 340/623-625, 669, 689; 73/444, 448, 451, 453, 454; 114/122, 123

[56] References Cited

U.S. PATENT DOCUMENTS

| | | | |
|---|---|---|---|
| 3,633,003 | 1/1972 | Talwani | 364/566 |
| 4,317,174 | 2/1982 | Dean | 364/453 |
| 4,401,888 | 8/1983 | West et al. | 364/559 |
| 4,549,627 | 10/1985 | Drabouski Jr. | 364/463 |
| 4,647,928 | 3/1987 | Casey et al. | 364/463 |

FOREIGN PATENT DOCUMENTS 57-149935 9/1982 Japan .

*Primary Examiner*—Gary Chin
*Assistant Examiner*—Brian M. Mattson
*Attorney, Agent, or Firm*—Flynn, Thiel, Boutell, & Tanis

[57] ABSTRACT

A stability meter comprises a translational accelerometer (1) which has a working axis along which it is sensitive to gravity. The meter is mounted on a vessel with the working axis horizontal when the vessel is in the upright position such that it transmits signals proportional to the sine of the angle of roll of the vessel to a microprocessor based apparatus (2). A microprocessor (12) conducts a Fast Fourier Transform on a plurality of samples from the accelerometer (1) in order to determine the dominant rolling frequency. The apparatus (2) comprises a display (8), a printer (9), a keyboard (10), a clock (14) and memory unit (16). The dominant rolling frequency is used to calculate the transverse metacentric height of the vessel. The value of the transverse metacentric height is transmitted to the display (8) as a measure of the stability of the vessel.

4 Claims, 6 Drawing Sheets

STABILITY METER FOR FLOATING OBJECTS

This application is a continuation of U.S. Ser. No. 07/124,108, filed Sept. 30, 1987 now abandoned.

This invention relates to the assessment of stability of floating objects and assessment of the transverse metacentric height of the object, for example a ship.

It is known to try to assess a vessel's stability from a measure of its rolling frequency. This is derived by counting the number of rolls of the vessel over a measured period of time.

The Wesmar SC44 stability computer, manufactured by Western Marine Electronics Inc., calculates the transverse metacentric height (GM) of a vessel from its predominant roll frequency as derived from a simple timing of the roll period of the vessel. A count of a plurality of rolls is taken in order to arrive at an average figure for the roll period. This count is recommended to take place over a period of thirty minutes or more for a large vessel. Thus, a long interval may elapse before a change in GM is recognized. Furthermore, the inconsistent nature of the waves causing the vessel to roll and the finite time over which the roll period can be averaged leads to errors and spurious readings.

According to the present invention, there is provided apparatus for assessing the stability of a floating object. The apparatus comprises a roll sensor which is sensitive to the component of gravitational force along a working axis of the sensor, the roll sensor being mounted in use on the object with the working axis horizontal when the object is floating in an upright position, and processing means, including analyzing means, for sampling the output of the roll sensor at predetermined intervals of time over a period, the analyzing means being adapted to determine the frequency components of the roll motion of the object from the samples for identification of the dominant roll frequency of the object.

The natural rolling frequency of a vessel can normally be identified as the frequency at which the roll power of the spectral function is largest.

The invention will now be described in more detail with reference to the accompanying drawings in which.

Figure 1:
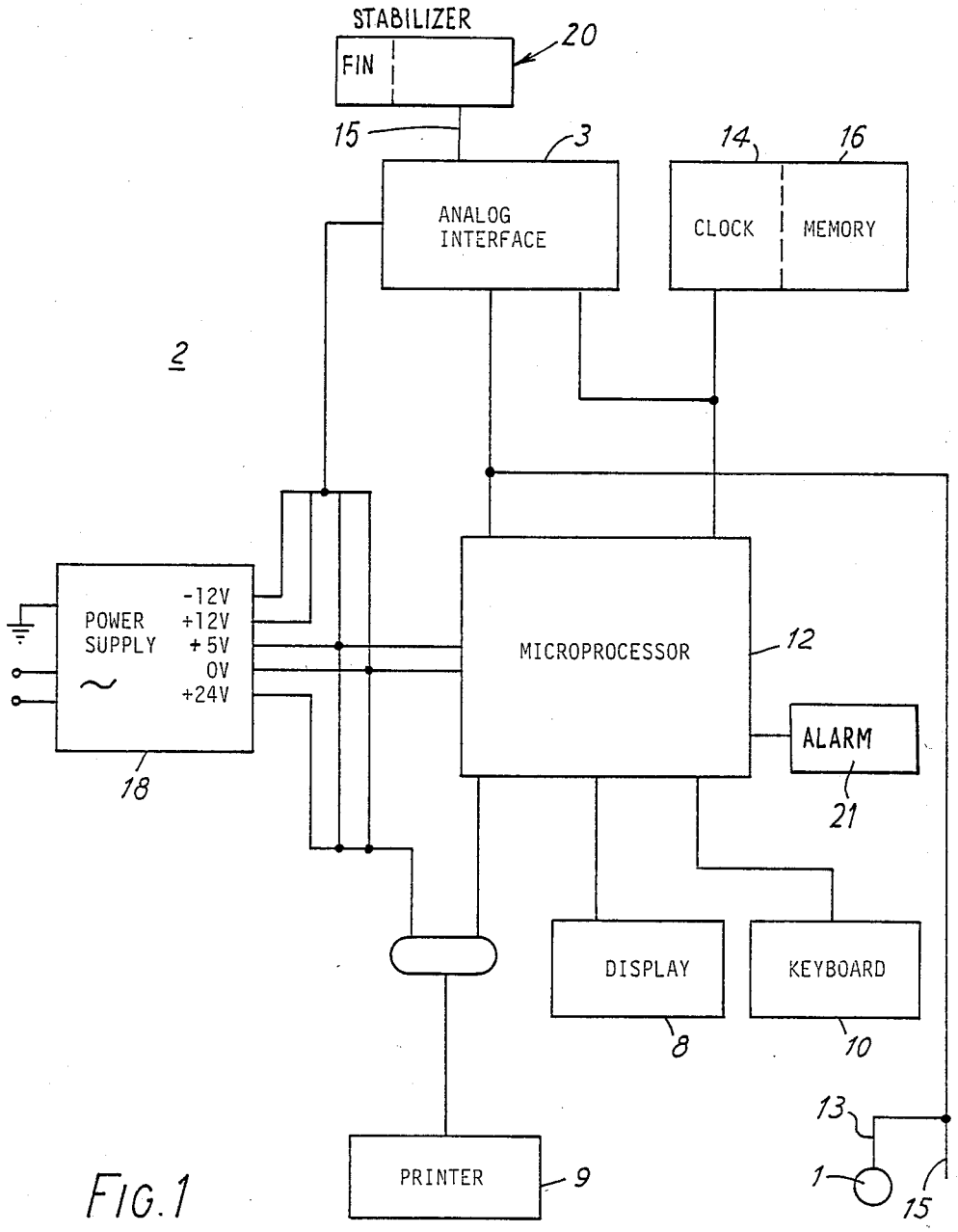
FIG. 1 is a schematic diagram of an apparatus incorporating the present invention.
Figure 2:
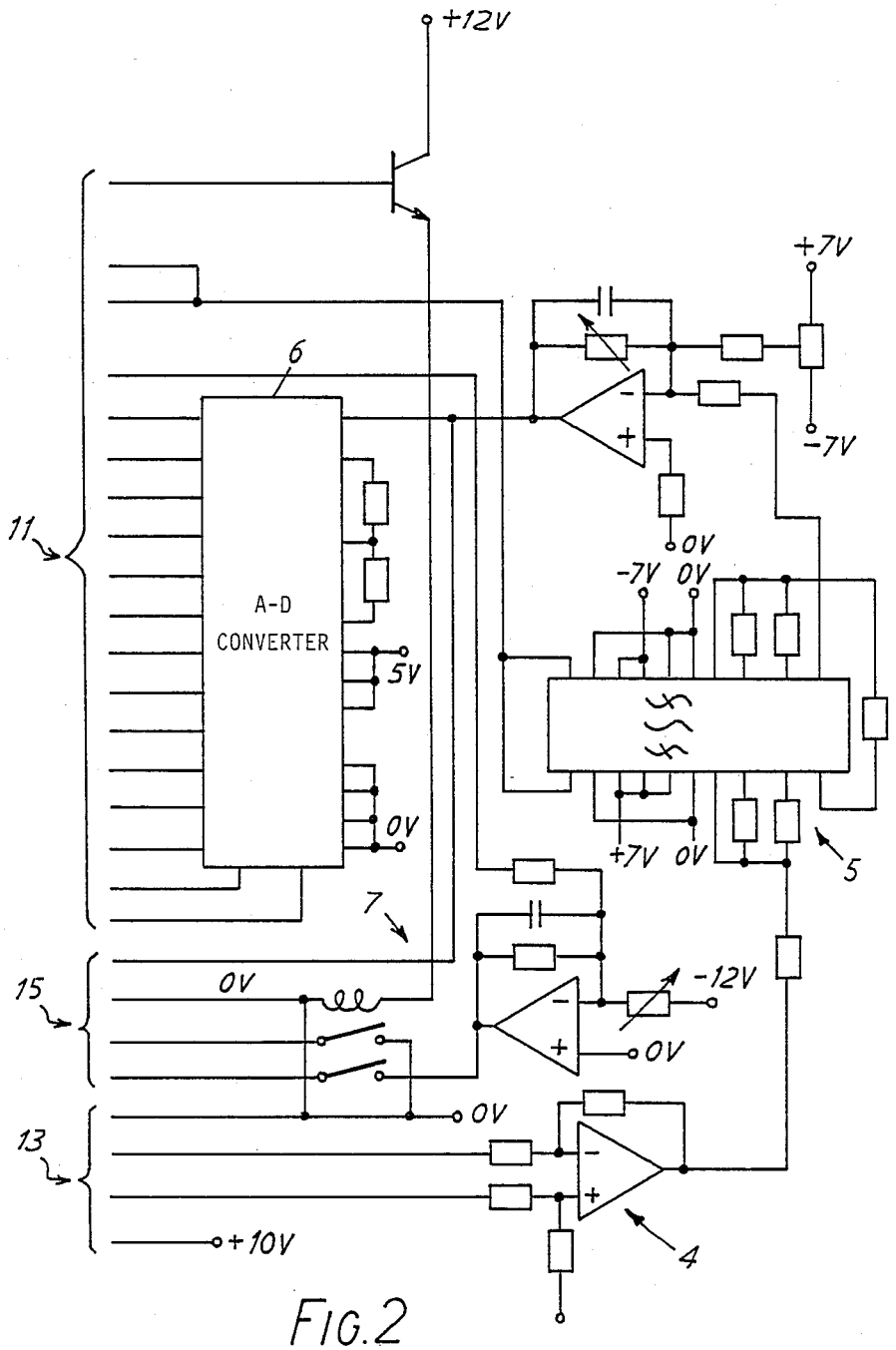
FIG. 2 is a schematic diagram of the analog interface in FIG. 1.

Referring to FIGS. 1 and 2, the apparatus comprises a transducer and an electronics unit 2. The transducer serves as a roll sensor and is a translational accelerometer 1, which in this embodiment is a Setra Model 141 translational accelerometer which is, in use, fixed to a bulkhead of a vessel in a vertical fore-and-aft plane thereof by a magnetic mount so that the sensitive axis of the accelerometer is in the lateral axis of the vessel.

With the accelerometer working axis thus horizontally mounted, it is insensitive to acceleration due to gravity when the vessel is in the upright position. As the vessel rolls away from the upright position, the accelerometer is increasingly affected by this acceleration in proportion to the sine of the angle of roll of the vessel. Alternatively, the translational accelerometer 1 could be replaced by a gyroscopic sensor or a rotational accelerometer.

The electronics unit 2 comprises a display 8, a thermal printer 9, a keyboard 10 with which to enter commands, a microprocessor controller 12, an analog interface 3, a real time clock 14, a complementary metal oxide semiconductor (CMOS) memory unit 16 and a power supply 18. The electronics unit 2 is mounted in a portable steel case which can be closed to protect against the elements. In a preferred embodiment, the microprocessor controller 12 is a Rockwell AIM 65/40.

The output leads of the accelerometer 1 are connected with the input to the analog interface 3 through lines 13. The analog interface comprises an accelerometer pre-amplifier 4, anti-aliasing filters 5, a 12-bit analog-to-digital converter 6 and buffers and switching 7 for stabilizer driving signals. The analog interface 3 is connected with the microprocessor controller 12 by means of a parallel input/output interface (not shown) through bus 11 and transmits stabilizer driving signals along lines 15.

The apparatus computes the natural rolling frequency of the ship by Fourier analysis of the roll time history from 512 samples taken at one second intervals from the accelerometer 1 using a Fast Fourier Transform algorithm. The natural roll frequency is identified as the dominant frequency within a predefined bandwidth of frequencies. The GM is then computed using the formula:

$$GM = \frac{4\pi^2 \cdot k^2 \cdot fn^2}{g}$$

where fn is the natural rolling frequency in hertz, k is the radius of roll gyration in meters and g is the acceleration due to gravity in meters per second$^2$.

Computation of the Fast Fourier Transform (FFT) based on the 512 samples takes a little more than a minute using the eight bit central microprocessor controller 12 running at one megahertz and using software written in the high level Fortran computer programming language. It is envisaged that in a development of this embodiment this time could be considerably reduced by the addition of a mathematical co-processor to the electronics unit.

With a natural frequency of roll of around 0.1 Hertz, this enables changes in the GM of four percent or greater to be identified. A finer analysis resolution would require a longer sample length, thus the compromise is between the resolution and the length of time before a new GM value is available.

The stability meter commands are summarized below.

G: Compute GM from free roll motion data.

G1: Compute GM from forced roll motion data and output stabilizer control signal.

G2: Compute GM repetitively under free roll until reset.

(known GM) G: Compute calibration constant ($k^2$) from free roll motion data using known GM. Enter known GM to 2 decimal places.

(known GM) G1: As above, but under forced roll.

G0: Measure current accelerometer angle.

K: Display current calibration constant ($k^2$)

(constant) K: Accept new calibration constant ($k^2$). Enter known k to 2 decimal places.

T: Display current time and date.

T.: Change time and date.

P: Print-out stored statistical data, starting with the most recent until any key is pressed.

P1: Print-out stored GM and natural frequency only.

P2: Print-out the last computed roll power spectrum.

P0: Erase store with no print-out.

PPP: Advances paper.

CNTRL P: Toggle printer on or off.

Each command is entered via the keyboard 10 followed by an 'enter' statement. In the case of commands requiring a numerical input, such as G, $G_1$ and $k^2$, the number is entered to 2 decimal places followed by a space, then the relevant command followed by 'enter'. If an invalid command is entered, the display 8 will respond with a question mark. Several commands may be entered at once, to be executed in turn: in this case, the commands are separated by a single space and the last one followed by 'enter'. When execution of the last command is complete, 'O.K.' is displayed on the display 8, indicating that the apparatus is ready to accept another command.

Figure 3:
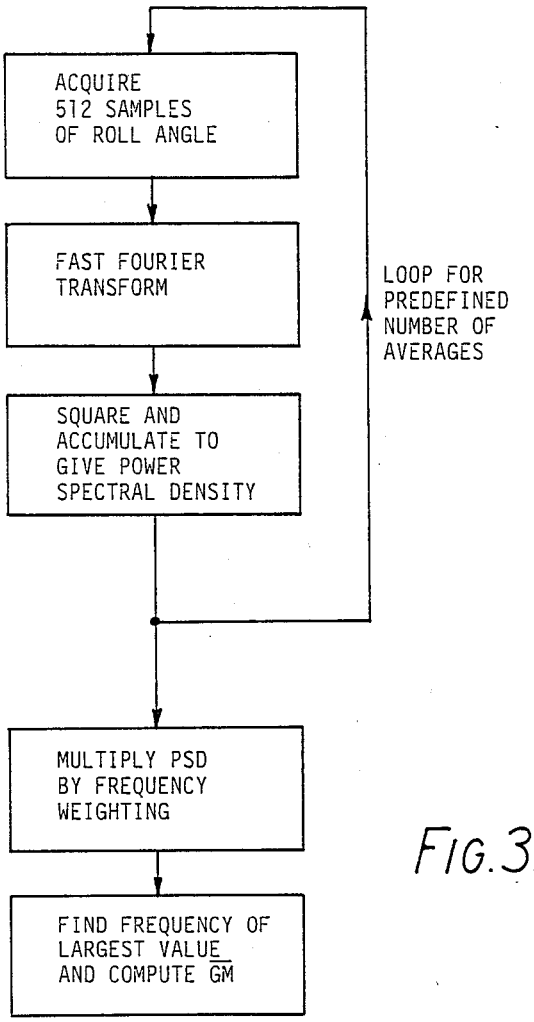
FIG. 3 is a flow chart of the method of computation of the metacentric height under free rolling conditions incorporated in one aspect of the present invention.
Figure 4:
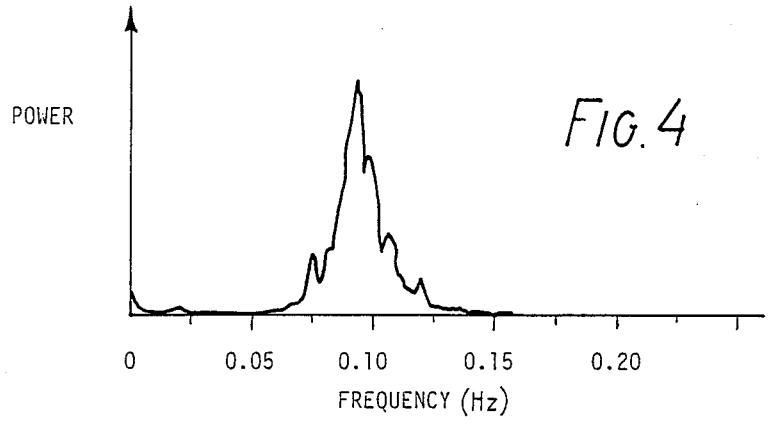
FIG. 4 is a graph of a typical roll power spectrum of a vessel under free rolling conditions.
Figure 5:
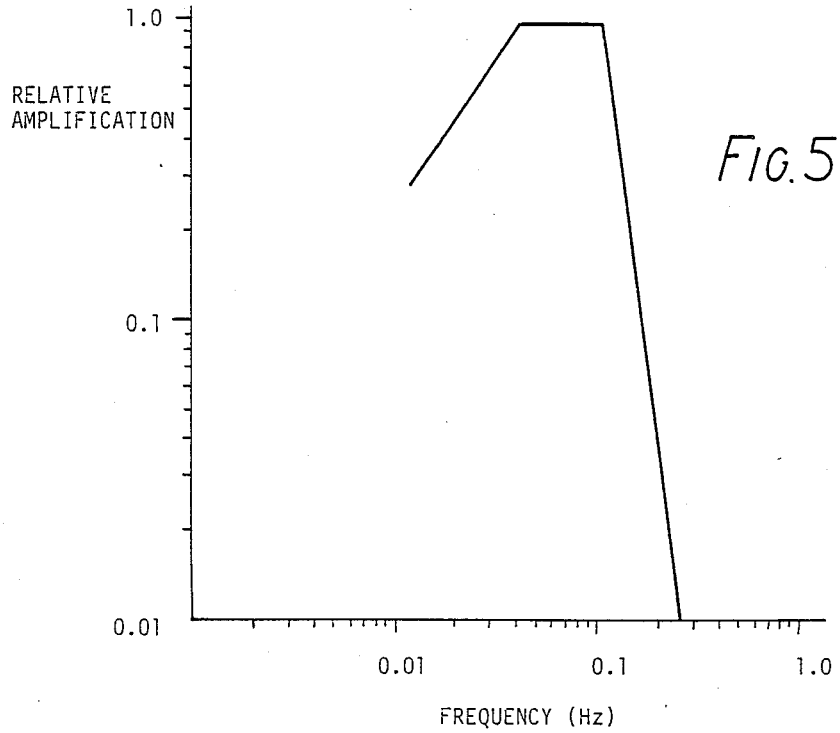
FIG. 5 is a graph of a weighting function used in the embodiment of the present invention.

Referring to FIG. 3, the value of fn can be measured under free rolling conditions by relying on the broadband excitation by the sea to roll the vessel predominantly near its natural or resonance frequency. A number of sets of samples of roll angle are taken, and the average of the FFT of these is squared to obtain the roll power spectral density. A typical roll power spectrum is illustrated in FIG. 4. This spectrum is then weighted by a predefined filter function (see FIG. 5), and the natural rolling frequency is then taken as the frequency between 0 Hz and a quarter of the sampling frequency at which the maximum weighted roll power occurs. This is then used in the formula mentioned previously to calculate GM.

Figure 6:
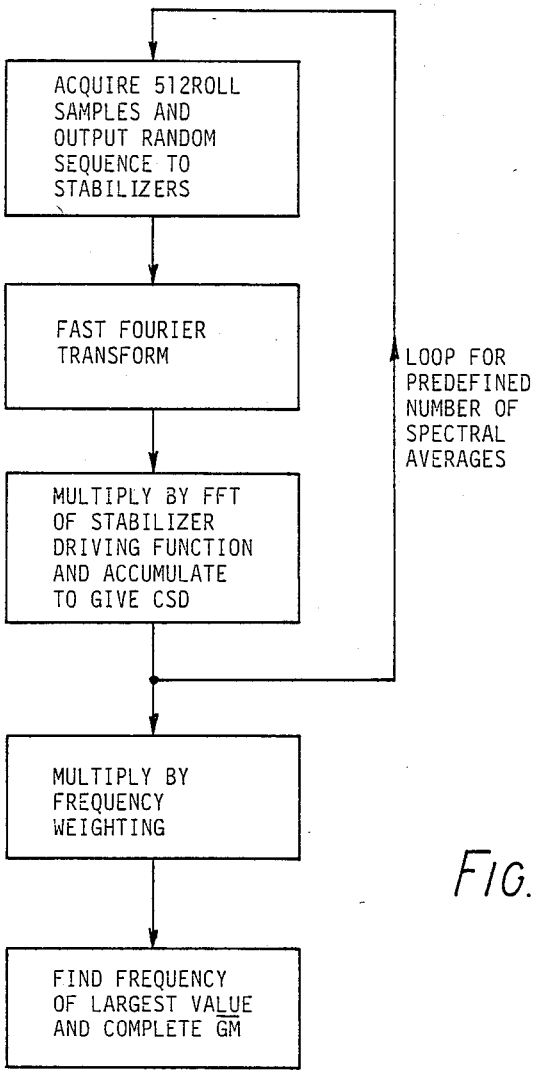
FIG. 6 is a flow chart of the method of computation of metacentric height under forced rolling conditions incorporated in another embodiment of the present invention; and FIGS. *7a, b* and *c* are graphs of typical roll gain of a vessel under forced rolling conditions.
Figure 7A:
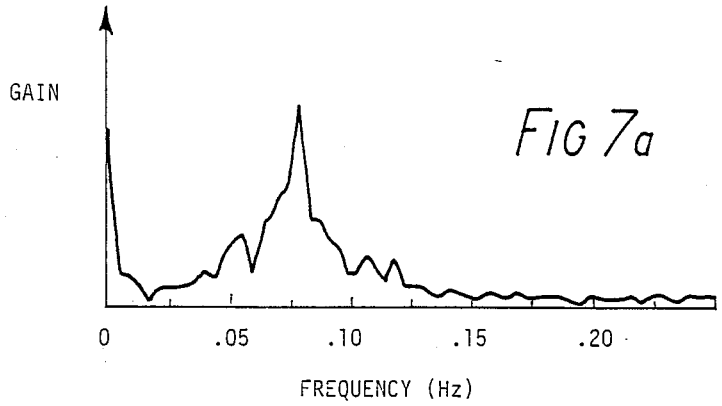
Figure 7B:
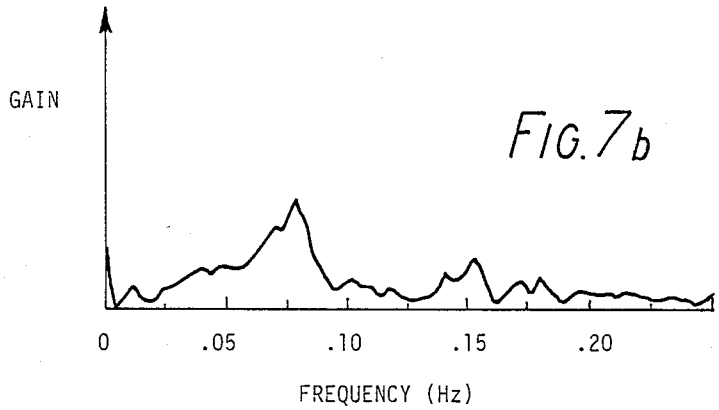
Figure 7C:
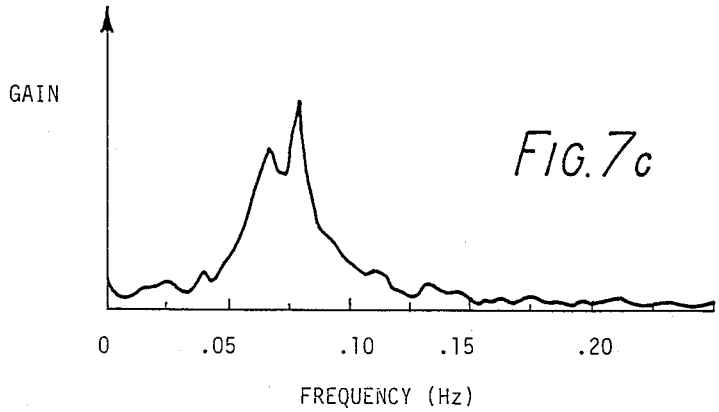

Referring to FIG. 6, an estimate of natural rolling frequency may be obtained by forced rolling of the vessel. In the forced rolling mode a pseudo-random forcing function is output from the stability meter to stabilizer fins 20 (FIG. 1) fitted to the hull of the vessel. This may necessitate the suspension of ormal stabilizer operation. Roll data are sampled in the same way as in the free rolling mode. Since the spectrum of the pseudo-random forcing function is taken to be flat between 0 and 0.25 Hertz, the cross power spectral density between fin stabilizer angle and the roll angle of the vessel is computed by the GM meter by multiplying the FFT estimate of the roll spectrum of the vessel by the FFT of the stabilizer driving function. An average of the thus derived cross power spectral density is taken from a number of sets of samples of roll angle. The roll transfer function of the vessel is then computed by dividing this cross spectral density by the power spectral density of the stabilizer fin angle. Three examples of such transfer functions are illustrated in FIGS. *7a, b* and *c*. The results are based on three separate 1024 second sampling periods.

For correct operation, the meter must be provided with an accurate value for the squared roll radius of gyration ($k^2$) of the vessel. This can be entered directly by the user via the keyboard 10 or can be computed by the instrument from a known value of GM.

In the latter case an inclining test has to be carried out after loading the vessel with stores and cargo. The value of GM determined in the inclining test is entered via the keyboard 10 and the value of k computed from the rolling frequency of the vessel. The value of k is retained in the CMOS memory 16.

The clock 14 is connected with the display 8 to give a check of the correct time and date and thus ensure that there has been no malfunction or loss of power within the apparatus which might lead to incorrect readings. If the instrumen has not been powered up for some time, the time and date indicated by the battery-backed real-time clock 14 may be incorrect. The battery, which drives the real-time clock 14 and the data memory 16, is charged continuously while the apparatus iis switched on. A full charge lasts for about 300 hours. The battery will maintain a sufficient charge to drive the clock 14 and data memory 16 provided that the apparatus is switched on for a total of 14 hours during every 300 hour period. If the battery has been allowed to discharge, it will be necessary to re-enter the time and date, and the calibration constant $k^2$ before GM can be estimated.

To read the current time and date, T is keyed in via the keyboard 10 followed by 'enter'. The display 8 will respond with a reading of the time.

To correct the time and date, T is keyed in again, then 'enter'. The display 8 will respond and the year, month, date, hour and minute, separated by points. The display 8 will respond with the correct time and data immediately after the least significant digit of the minute is entered.

To enter a new calibration constant k, the new value is keyed in, followed by a space, then k.

Alternatively, if the current GM is known and the apparatus is required to compute $k^2$ from the natural rolling frequency fn of the vessel, the known GM (to 2 decimal places) followed by a space is keyed in, then G1 followed by 'enter'.

There is a delay of 512 seconds while roll data is acquired by the instrument. Statistics of the roll data are then printed by the printer 9.

There is a further delay of approximately 100 seconds while the value of $k^2$ is computed. Finally, the instrument displays the natural rolling frequency fn and the computed value of $k^2$, which is then stored in the battery-backed memory 16.

To compute $k^2$ under forced rolling conditions, the normal operation of the stabilizers has to be disabled and the apparatus connected with the stabilizer input. The same procedure described above for free roll is used.

GM can be estimated under free or forced rolling conditions, provided that a valid calibration constant $k^2$ is held in the battery-backed memory 16. Again, there is a delay of 512 seconds while roll data is acquired by the apparatus. Statistical data are then printed. The computation of GM then takes a further 100 seconds.

The displayed values of GM and natural frequency are automatically stored in battery-backed memory 16 with the current time and date. To estimate GM under forced rolling conditions, the instrument is connected with the stabilizer controls as previously described. The command G1 is entered to begin data acquisition, which proceeds as for free roll.

The keyboard command G2 instructs the apparatus to repetitively compute GM under free roll until reset is pressed.

If the instrument has not been powered up for some time, the data in battery-backed memory 16 may have been corrupted. If this has occurred, the store can be erased before computing GM or $k^2$. Previous estimates of GM, natural rolling frequency and roll statistics can be printed out by entering P on the keyboard 10. The instrument will then proceed to print-out all previous estimates currently held in the battery-backed CMOS memory 16, starting with the most recent. This sequence can be aborted at any time by pressing any key on the keyboard 10.

Up to 63 estimates of GM and natural frequency can be held in memory 16. When the memory is full, the stored data will be overwritten starting with the least recent estimate of GM. The P0 command erases the store without printing out the data. The P1 command prints out previous estimates of GM and natural frequency only, omitting the roll statistics. The P2 command prints out the last computed roll power spectral density, in 0.0019531 Hz (i.e. 1/512th Hz) increments, beginning at 0 Hz.

As stated above, this embodiment of the stability meter has a sampling time of about 8.5 minutes. In a further embodiment, a solution to the problem of finding a compromise between accuracy of the estimate of GM and the speed of response is realized by concurrently computing two GM values. The first GM value is based on a short period, i.e. having a fast response but relatively worse accuracy than a second GM value hich is calculated over a relatively longer period which is concomittantly more accurate.

In a development of the stability meter, a potentially dangerous situation, in which the metacentric height has reached a critical low value, can be brought to the attention of those on watch by means of an audio/visual alarm system 21 (FIG. 1). This alarm is actuated by a command from the microprocessor on receipt of a reading of the GM which is below a predetermined level.

In another development of the stability meter, steady or low frequency periodic signals can be output to drive the stabilizer fins. The meter can then directly compute the GM of the vessel from the inclinations produced in roll by a given fin angle (after filtering out the action of the sea) and the speed of the vessel. The meter can alternatively be synchronized with, or employed to cause, inclinations of the vessel by means other than the stabilizer fins, such as moving the rudder, alteration to the ship's propulsion system, pumping fluids from one side of the vessel to the other or the movement of other objects.

The stability meter may also include means for the determination and presentation of the average angle of list of the vessel over the most recent and all previous periods while the vessel is stationary or while underway and experiencing excitation from wind or waves.

We claim:

1. Apparatus for generating a signal representing the metacentric height of a floating object, comprising:

roll sensor means, which has an output and means for facilitating a fixed coupling of said roll sensor means to a floating object, for producing at said output a signal which varies in response to variation of an angle of inclination of the object; and signal generating means coupled to said output of said roll sensor means and including: means for sampling in a first operational mode said signal from said output of said roll sensor means at predetermined time intervals over a time period; means for analyzing in a second operational mode said samples acquired in said first operational mode to determine a frequency spectrum which defines a roll motion of the floating object and which has frequency components within a predetermined bandwidth; means for identifying in a third operational mode one of said frequency components as a dominant frequency component within said frequency spectrum; and means for determining in a fourth operational mode a metacentric height of the floating object from said dominant frequency component, said signal generating means having at least one output and means for producing at said output of said signal generating means a signal representing said metacentric height of said object.

2. Apparatus according to claim 1, wherein said signal generating means includes means for weighting said frequency spectrum in order to enhance the dominant frequency component with respect to all other said frequency components.

3. Apparatus according to claim 1, including roll stabilizer control means for controlling roll motion of said object; and wherein said signal generating means has a control output coupled to said roll stabilizer control means and has means for producing at said control output a roll stabilizer control signal which causes said stabilizer control means to induce a pseudo-random roll motion of the object, said dominant frequency component of the object being determined from samples taken in said first operational mode during said pseudo-random roll motion.

4. Apparatus according to claim 1, including means responsive to said metacentric height being less than a predetermined value for generating an operator perceptible alarm.

* * * * *